United States Patent [19]

Moore

[11] Patent Number: 4,624,383

[45] Date of Patent: Nov. 25, 1986

[54] ENVIRONMENTAL BUILDING BLOCK CONTAINER SYSTEM

[76] Inventor: Roger F. Moore, 1151 S. Federal Hwy., Lot #19, Pompano Beach, Fla. 33062

[21] Appl. No.: 788,622

[22] Filed: Oct. 17, 1985

[51] Int. Cl.[4] ..... B65D 21/02

[52] U.S. Cl. ..... 220/23.4; 220/23.6; 206/509

[58] Field of Search ..... 220/23.6, 23.4; 206/507, 508, 509

[56] References Cited

U.S. PATENT DOCUMENTS

| | | | |
|---|---|---|---|
| 3,194,426 | 7/1965 | Brown, Jr. | 220/23.4 |
| 3,338,452 | 8/1967 | Oakley et al. | 220/23.4 |
| 3,369,658 | 2/1968 | Hasselmann | 220/23.4 X |
| 3,391,824 | 7/1968 | Wiseman | 206/509 |
| 3,583,590 | 6/1971 | Ferraro | 215/10 |
| 3,933,268 | 1/1976 | Buske | 220/23.4 |
| 3,994,408 | 11/1976 | Belitzky | 215/10 |

*Primary Examiner*—Steven M. Pollard

*Attorney, Agent, or Firm*—Oltman and Flynn

[57] ABSTRACT

The interlocking environmental container allows milk, juice and various food containers to be saved for use as building blocks for such items as children's toys, lawn furniture or sheds. Tongue and groove construction of one pair of opposing sides combined with top and bottom mounting means and special corner pieces allows the containers to be built into semi-rigid structures. The invention is both a retail marketing aid and a conservation aid. Plastic containers are preferred for the strongest building blocks, but any other container material can be used.

3 Claims, 15 Drawing Figures

ENVIRONMENTAL BUILDING BLOCK CONTAINER SYSTEM

SUMMARY OF THE INVENTION

The primary object of the present invention is to add value to a product by designing its container for a minor extra cost to function as a building block. After the product is consumed these building block containers can be used as children's erector set type toys or as lawn furniture stools, tables, sheds, and various other forms. This added value at no extra cost is expected to increase retail sales.

Another object of the present invention is to provide a conservation aid to the public. Reducing the milk, juice and other container trash on a national basis can reduce the amount of solid waste disposal.

Other objects of this invention will appear from the following description and appended claims, reference being had to the accompanying drawings forming a part of this specification wherein like reference characters designate corresponding parts in the several views.

Before explaining the disclosed embodiments of the present invention in detail, it is to be understood that the invention is not limited in its application to the details of the particular arrangements shown, since the invention is capable of other embodiments. Also, the terminology used herein is for the purpose of description and not of limitation.

DETAILED DESCRIPTION

Figure 1:
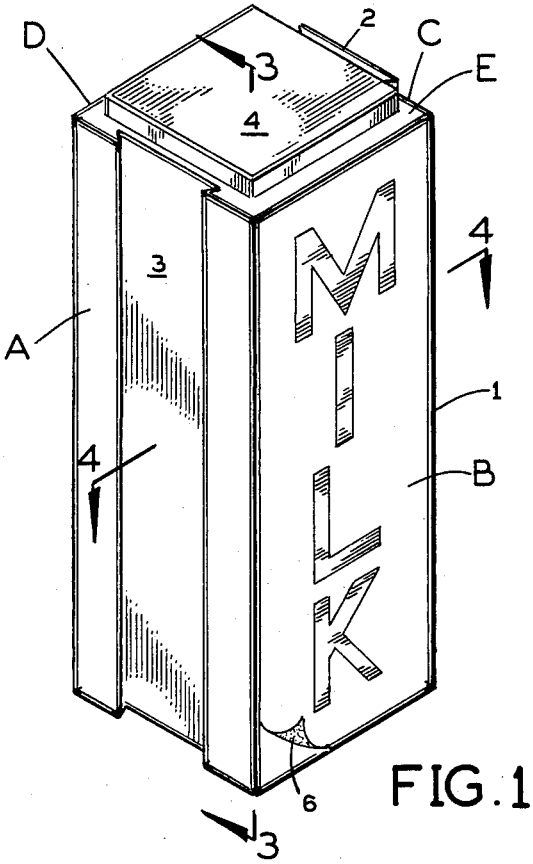
FIG. 1 is a top perspective view of a milk container having tongue and groove sides and an interlocking top.

Referring first to FIG. 1, a container 1, has a tongue 2, which interlocks with groove 3 of an adjacent container (see FIGS. 5, 7, 12, 13 and 14). Tongue 2 is typically located on the side C which is opposite the groove 3 on side A. Top E has an extension 4 which interlocks with indentation 5 on the bottom F of an adjacent container (see FIGS. 2, 3, 7 and 14). Any appropriate labeling means such as stick-on "Milk" label 6 may be used on any container on any side. The container may be made of plastic or any suitable material.

Figure 2:
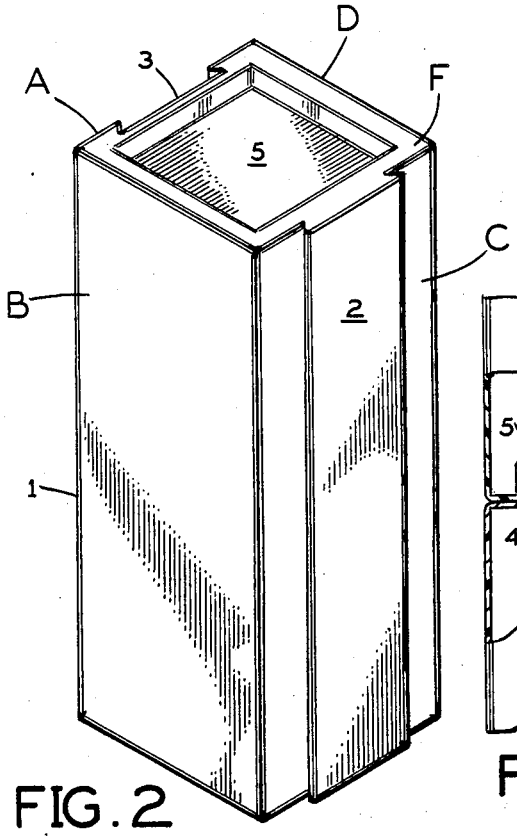
FIG. 2 is a bottom perspective view of the container of FIG. 1 showing the tongue and groove sides and an interlocking bottom.

FIG. 2 shows indentation 5 which interlocks with extension 4 of the same type container 1 as shown in FIG. 1.

Figure 3:
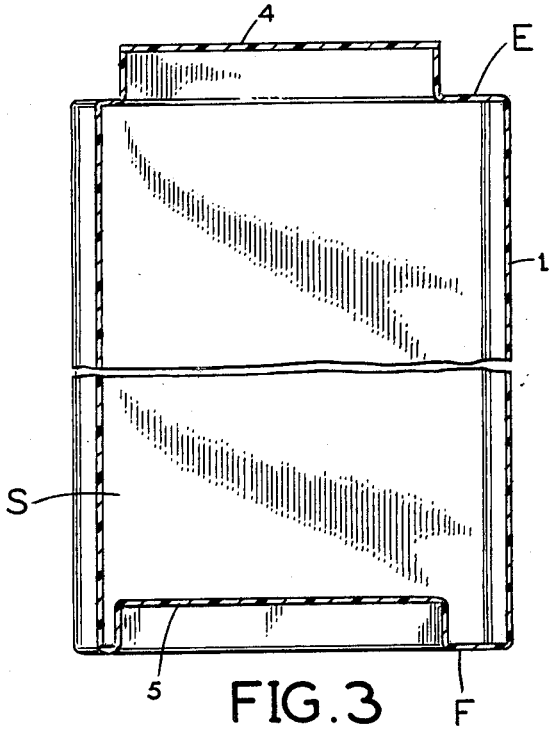
FIG. 3 taken along lines 3—3 of FIG. 1 is a sectional view of a container showing how the top and bottom interlocking sections have the same size and shape.

FIG. 3 shows the symmetrical relation between extension 4 on top E of container 1 and indentation 5 on the bottom F. Any appropriate pouring means may be used on top E including perforated cut-outs, tape or spouts. Interior space S may optionally be filled with any appropriate filler including cement, plaster or sand.

Figure 4:
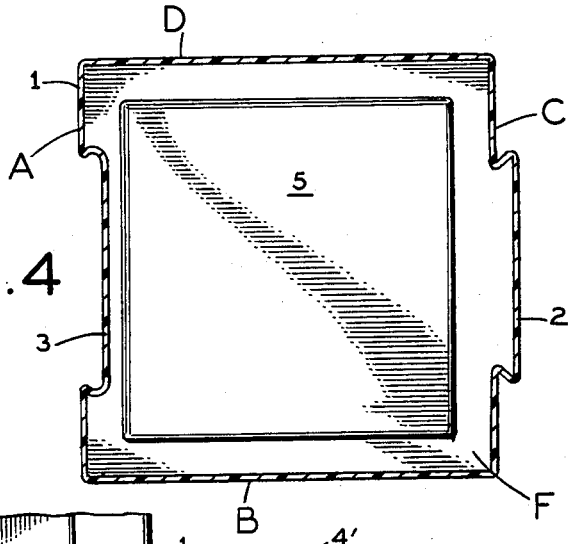
FIG. 4 taken along lines 4—4 of FIG. 1 is a cross sectional view of a container having a pair of sides with a tongue and groove shape.

FIG. 4 shows the symmetrical relation between tongue 2 and groove 3 on opposite sides C and A respectively. The shape of the container 1 may be any polygon.

Figure 5:
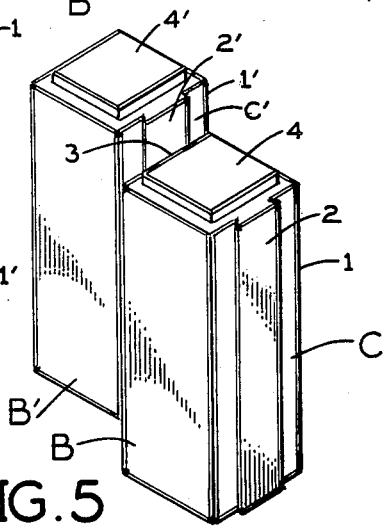
FIG. 5 is a top perspective view showing how two containers interlock along the sides.

FIG. 5 shows containers 1 and 1' interlocked by the tongue 2' and groove 3. Sides B and B' fit flush together.

Figure 6:
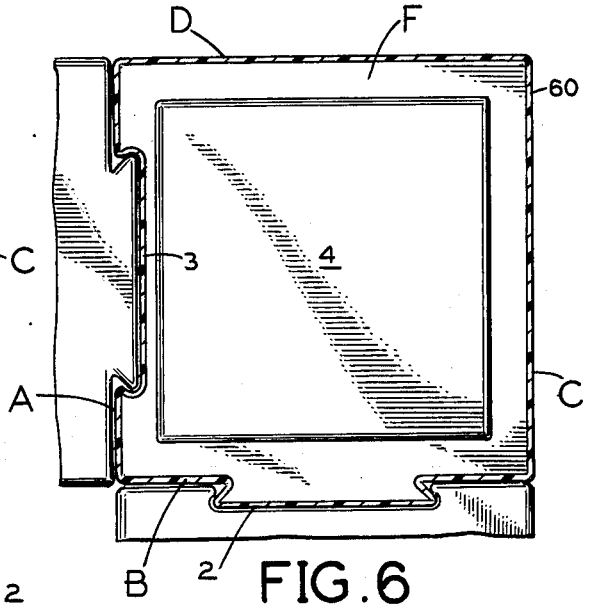
FIG. 6 is a top cross sectional view of a corner container showing the tongue and groove sides adjacent to each other.

FIG. 6 shows a corner container 60 having tongue 2 and groove 3 on adjacent sides B and A respectively.

Figure 7:
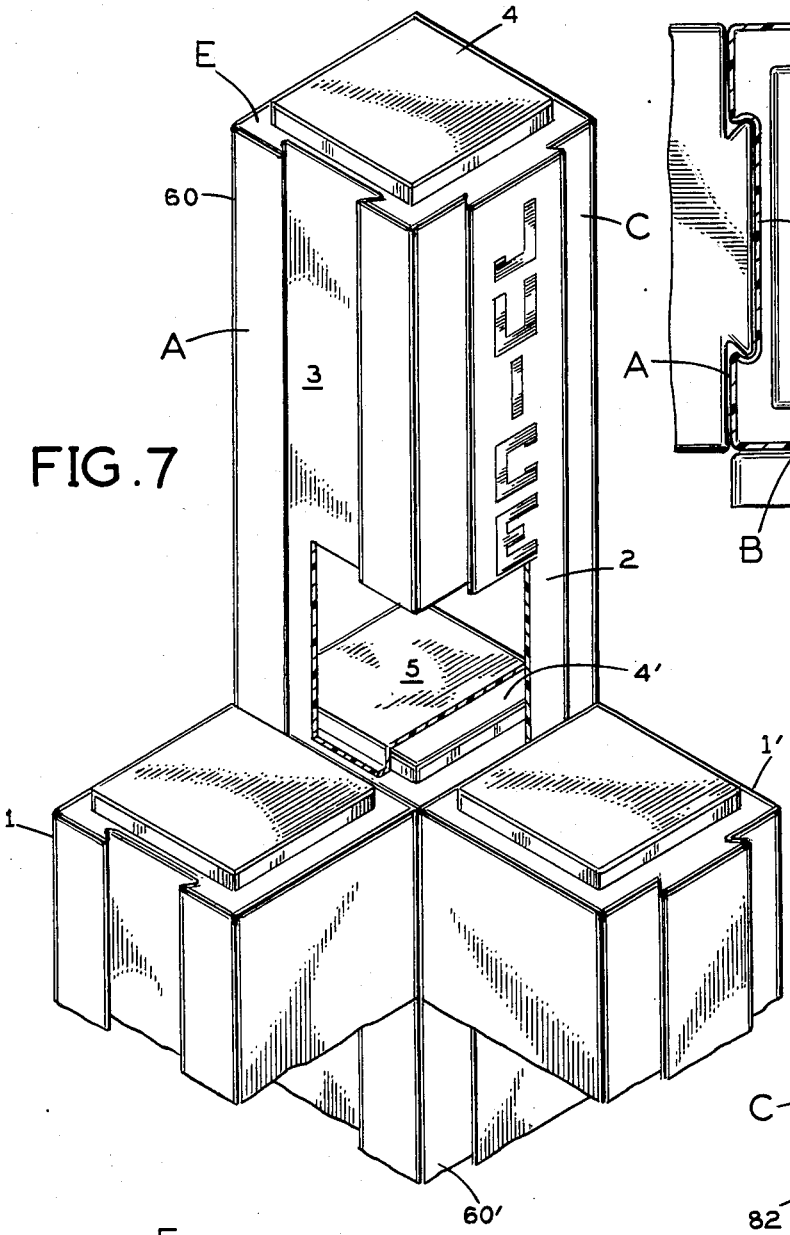
FIG.7 is a top perspective fragmentary view of two corner containers interlocked with two side pieces.

FIG. 7 shows corner container 60' interlocked with containers 1 and 1'. Corner container 60 is interlocked on top of corner container 60'. Corner container 60 bottom indentation 5 interlocks with corner container 60' top extension 4'.

Figure 8:
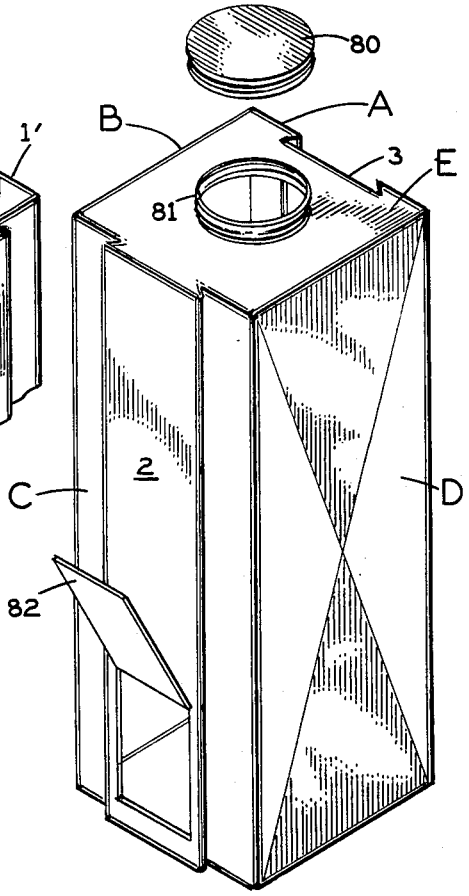
FIG. 8 is a top perspective view of a container embodiment with a screw cap and pop out bottom panel.
Figure 9:
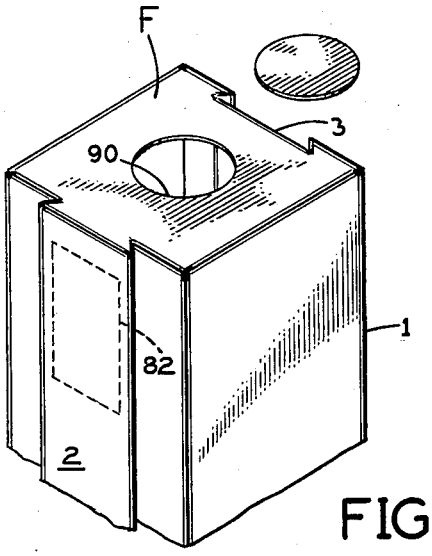
FIG. 9 is a bottom perspective view of the container in FIG. 8 showing the pop out hole in the bottom used to interlock the screw top.

FIG. 8 shows a different top embodiment for interlocking purposes. Threaded cap 80 affixedly screws onto threaded neck 81 thereby sealing container 1 prior to the consumption of the contents. After consumption threaded neck 81 fits into punch-out or cut-out hole 90 on the bottom of the adjacent container (see FIGS. 9, 10 and 11). Punch-out or cut-out flap 82 allows cap 80 to be inserted into the container and threaded onto neck 81 of the adjacent container thereby interlocking the two containers together (see FIG. 10).

Figure 10:
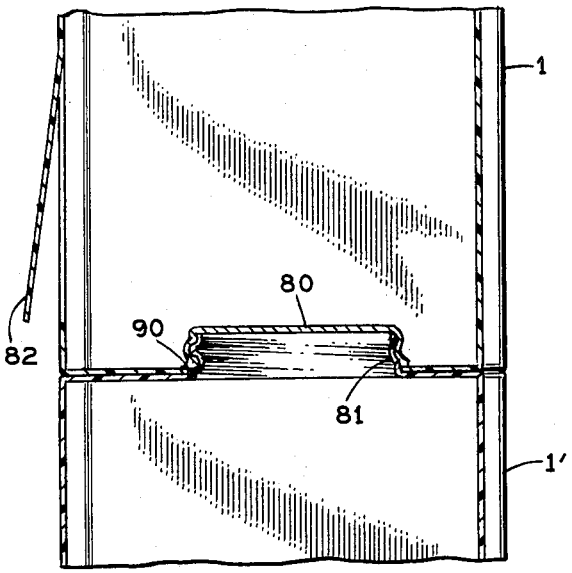
FIG. 10 is a sectional view of the containers in FIGS. 8 and 9 showing the cap affixing the two containers together.

If the top of FIG. 10 were large with a large neck and cap such that the hand could be inserted through the top, the side flap would not be needed.

FIG. 10 shows flap 82 open allowing fingers to reach in and screw tighten cap 80 on neck 81 thereby interlocking containers 1 and 1'.

Figure 11:
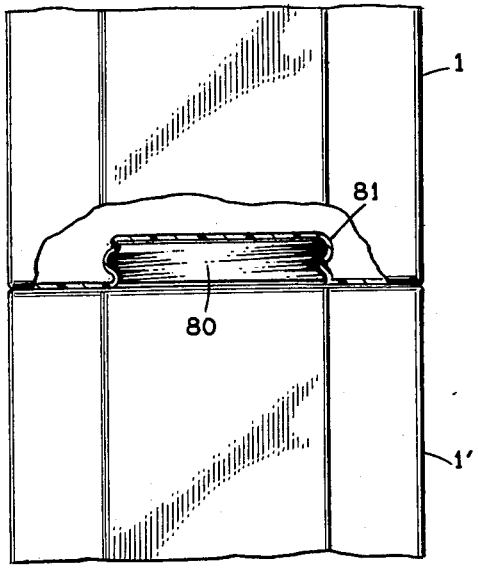
FIG. 11 is a fragmentary side view of the container of FIG. 10 showing the cap.

FIG. 11 shows a different embodiment of cap 80 and hole 90 wherein cap 80 screws directly into hole 90. This emobodiment eliminates the need for flap 82.

Figure 12:
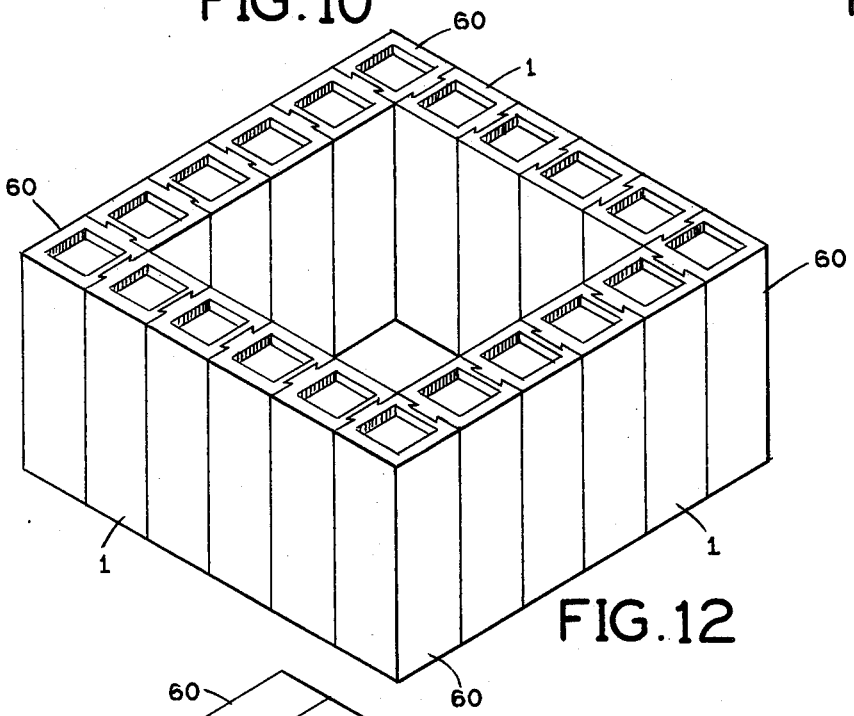
FIG. 12 is a bottom perspective view of an interlocked square configuration of containers.

FIG. 12 shows a series of containers 1 and corner containers 60 interlocked into a platform formation.

Figure 13:
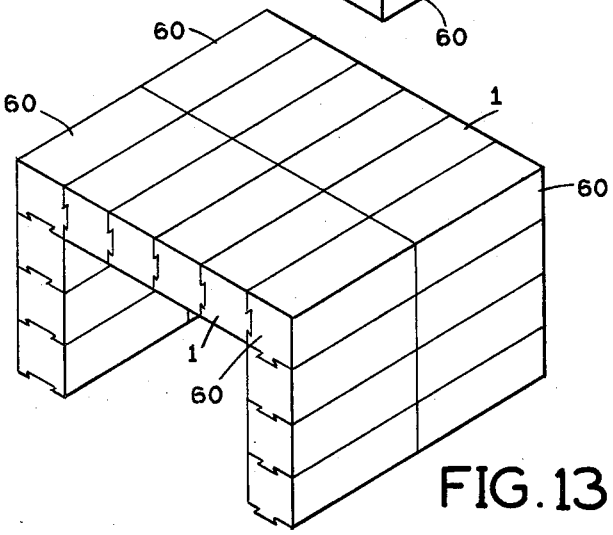
FIG. 13 is a top perspective view of an interlocked table configuration of containers.

FIG. 13 shows a series of containers 1 and corner containers 60 interlocked into a stool formation.

Figure 14:
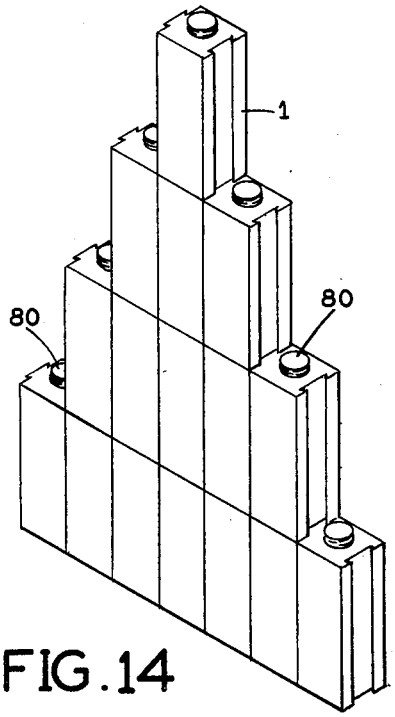
FIG. 14 is a top perspective view of an interlocked decorative configuration of containers.

FIG. 14 shows a series of containers 1 stacked and interlocked into a decorative triangular formation.

Other embodiments can include the same interlocking symmetrical container systems wherein the containers are initially used as cargo crates of rigid construction.

Figure 15:
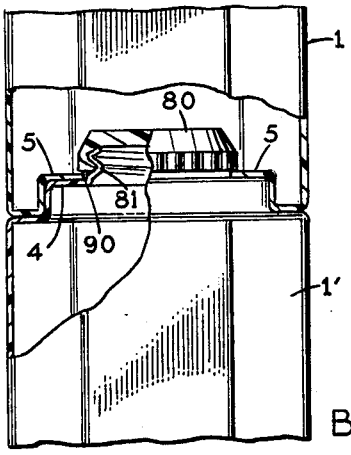
FIG. 15 is a fragmentary side view of the container of FIG. 10 showing the cap on an extended top embodiment.

FIG. 15 shows an embodiment which has an extension 4 upon which threaded cap 80 is mounted. Extension 4 fits into indentation 5. Containers 1 and 1' are held together by cap 80 tightening down on threaded neck 81.

I claim:

1. A container system comprising a plurality of symmetrical containers wherein each container is a polygon having at least one side consisting of a tongue and at least one side consisting of a groove symmetrically identical to said tongue, and wherein each container has a top and bottom consisting of interlocking means to the tops and bottoms of said symmetrical containers, whereby said tongue and groove and top and bottom interlocking means function to enable the construction of structures consisting of said interlocked containers, said top and bottom interlocking means further comprising a threaded neck with closing cap atop said container and a punch out or cut-out hole on the bottom of said container whereby said hole is substantially the same diameter of said threaded neck, whereby said threaded neck and cap may be interlockingly screwed into said hole of an adjacent container.

2. A container system comprising a plurality of symmetrical containers wherein each container is a polygon having at least one side consisting of a tongue and at least one side consisting of a groove symmetrically identical to said tongue, and wherein each container has a top and bottom consisting of interlocking means to the tops and bottoms of said symmetrical containers, whereby said tongue and groove and top and bottom interlocking means function to enable the construction of structures consisting of said interlocked containers, said top and bottom interlocking means further comprises a threaded neck with closing cap atop said container and a punch-out or cut-out hole on the bottom of said container whereby said hole is substantially the same diameter of said threaded neck and a punch-out or cut-out flap on at least one side of said container, whereby said cap may function to interlock said adjacent containers by screwing said cap onto said threaded neck of said adjacent container after said threaded neck has been inserted into said hole on the bottom of said adjacent container.

3. The container system of claim 2 wherein said threaded neck is mounted atop a top extension and said hole is mounted in a matching bottom indentation.

* * * * *